US010557451B2

(12) United States Patent
Takeuchi et al.

(10) Patent No.: US 10,557,451 B2
(45) Date of Patent: Feb. 11, 2020

(54) CERAMIC HEATER AND GLOW PLUG

(71) Applicant: NGK Spark Plug Co., LTD., Nagoya (JP)

(72) Inventors: Hiroki Takeuchi, Niwa-gun (JP); Yoshihito Ikai, Tsushima (JP)

(73) Assignee: NGK Spark Plug Co., LTD., Nagoya (JP)

( * ) Notice: Subject to any disclaimer, the term of this patent is extended or adjusted under 35 U.S.C. 154(b) by 670 days.

(21) Appl. No.: 15/252,391

(22) Filed: Aug. 31, 2016

(65) Prior Publication Data

US 2017/0074228 A1 Mar. 16, 2017

(30) Foreign Application Priority Data

Sep. 10, 2015 (JP) ..... 2015-178311

(51) Int. Cl.
*F02P 19/02* (2006.01)
*F23Q 7/00* (2006.01)

(52) U.S. Cl.
CPC ..... *F02P 19/02* (2013.01); *F23Q 7/001* (2013.01)

(58) Field of Classification Search
CPC ..... F02P 19/02; F02P 19/021; F02P 19/023; F02P 19/025; F02P 19/026; F02P 19/027; F02P 19/028; F23Q 7/001; F23Q 2007/004; H05B 3/48; H05B 2203/027; H05B 3/141; H05B 2203/017
See application file for complete search history.

(56) References Cited

U.S. PATENT DOCUMENTS

2006/0011602 A1 1/2006 Konishi et al.
2009/0179023 A1 7/2009 Annavarapu et al.
2009/0320782 A1 12/2009 Hiura
(Continued)

FOREIGN PATENT DOCUMENTS

EP 1612486 A 1/2006
EP 1998596 A 12/2008
EP 2247156 * 11/2010
(Continued)

OTHER PUBLICATIONS

Office Action dated Mar. 14, 2018 for the corresponding Korean Patent Application No. 10-2016-0106822.
(Continued)

*Primary Examiner* — Shawntina T Fuqua
(74) *Attorney, Agent, or Firm* — Leason Ellis LLP

(57) ABSTRACT

A ceramic heater includes a substrate containing a ceramic, and a resistor containing another ceramic and embedded in the substrate. The resistor includes two lead portions, a joint portion that connects the two lead portions, an electrode portion formed integrally with at least one lead portion, having one end portion connected to the one lead portion, extending in a direction crossing an axis of the one lead portion, and having the other end portion exposed at the surface of the substrate. In a cross section of the electrode portion taken along an imaginary plane passing through the axis of the one lead portion and parallel to an extending direction of the electrode portion, $0.1 \leq A/B \leq 0.8$ is satisfied, where A is the length of the other end portion parallel to the axis, and B is the length of the one end portion parallel to the axis.

6 Claims, 9 Drawing Sheets

(56) References Cited

U.S. PATENT DOCUMENTS

| | | | |
|---|---|---|---|
| 2010/0213188 | A1 | 8/2010 | Nishihara et al. |
| 2011/0068091 | A1 | 3/2011 | Hiura |

FOREIGN PATENT DOCUMENTS

| | | | |
|---|---|---|---|
| EP | 2247156 | A | 11/2010 |
| JP | 02-20293 | U | 2/1990 |
| JP | 2004-119312 | A | 4/2004 |
| JP | 2007-240080 | A | 9/2007 |
| JP | 2010-073425 | A | 4/2010 |
| KR | 10-2009-0111805 | | 10/2009 |

OTHER PUBLICATIONS

Extended European Search Report dated Feb. 1, 2017 for the corresponding European Patent Application No. 16187876.4.
Office Action dated Nov. 24, 2017 for the corresponding Japanese Patent Application No. 2016-170757.

* cited by examiner

| | NUM-BER | A/B | A | B | STRENGTH | | RESISTANCE | | c | d |
|---|---|---|---|---|---|---|---|---|---|---|
| EXAMPLE | 1 | 0.8 | 5 | 6.25 | A | 1100 | A | 650 | 0.31 | 0.94 |
| | 2 | 0.7 | 4 | 5.71 | A | 1160 | A | 680 | 0.43 | 1.29 |
| | 3 | 0.6 | 3 | 5.00 | A | 1200 | A | 660 | 0.50 | 1.50 |
| | 4 | 0.5 | 5 | 10.00 | A | 1280 | A | 640 | 1.25 | 3.75 |
| | 5 | 0.5 | 3 | 6.00 | A | 1300 | A | 640 | 0.75 | 2.25 |
| | 6 | 0.3 | 2 | 6.67 | A | 1320 | A | 640 | 1.17 | 3.50 |
| | 7 | 0.1 | 1 | 10.00 | A | 1310 | A | 650 | 2.25 | 6.75 |
| | 8 | 0.5 | 8 | 16.00 | B | 1030 | A | 660 | 2.00 | 6.00 |
| | 9 | 0.5 | 0.05 | 0.10 | A | 1350 | B | 980 | 0.01 | 0.04 |
| | 10 | 0.5 | 3 | 6.00 | A | 1050 | A | 650 | 2.00 | 1.00 |
| | 11 | 0.5 | 3 | 6.00 | A | 1080 | A | 660 | 1.50 | 1.50 |
| | 12 | 0.5 | 3 | 6.00 | A | 1200 | A | 640 | 1.00 | 2.00 |
| | 13 | 0.5 | 3 | 6.00 | A | 1350 | A | 650 | 0.50 | 2.50 |
| COM-PAR ATIVE EXAMPLE | 1 | 2 | 5 | 2.50 | C | 800 | A | 610 | 0.63 | 1.88 |
| | 2 | 1 | 3 | 3.00 | C | 950 | A | 620 | 0.00 | 0.00 |
| | 3 | 0.05 | 1 | 20.00 | A | 1320 | C | 650 | 4.75 | 14.25 |

FIG. 8

CERAMIC HEATER AND GLOW PLUG

This application claims the benefit of Japanese Patent Application No. 2015-178311, filed Sep. 10, 2015, which is incorporated herein by reference in its entity.

FIELD OF THE INVENTION

The present invention relates to a ceramic heater and to a glow plug provided with the ceramic heater.

BACKGROUND OF THE INVENTION

A conventional glow plug used for ignition assistance for internal combustion engines includes a heater in which a resistor formed of a conductive ceramic is disposed inside a substrate formed of an insulating ceramic. The resistor includes two rod-shaped lead portions, an approximately U-shaped joint portion that connects one end of one of the lead portion to one end of the other lead portion, and electrode portions disposed so as to protrude from the lead portions toward the outer circumferential surface of the substrate. The resistor generates heat when current is supplied to the resistor through the electrode portions. The resistor and substrate used for the heater are produced from materials each containing a ceramic and a binder (such as a resin). For example, as described in Japanese Patent Application Laid-Open (kokai) No. 2007-240080, a green intermediate molded product that later becomes the resistor in a subsequent step is formed by injection molding of a molding material containing a ceramic and a binder, and the intermediate molded product is subjected to debindering and firing, whereby the resistor is produced.

Problems to be Solved by the Invention

When a green resistor is placed in a die and then a material such as a ceramic is injected into to the die to form a green substrate such that it surrounds the green resistor, a space not filled with the material may remain near the electrode portions of the lead portions. Such a space becomes a cavity in a completed heater obtained through the subsequent debindering and firing steps. The presence of such a cavity causes a problem in that cracking starts from the cavity and the heater is damaged.

This problem is not specific to injection molding but is common to other molding methods usable to form the substrate such as powder press forming in which a powdery material is compressed, sheet laminating molding in which sheet-shaped materials are laminated, and casting. Moreover, this problem is not specific to ceramic heaters used for glow plugs but is common to ceramic heaters used for ignition heaters and various sensors.

SUMMARY OF THE INVENTION

Means for Solving the Problems

The present invention has been made to solve the foregoing problem and can be embodied in the following modes.

(1) According to one mode of the present invention, a ceramic heater is provided. This ceramic heater comprises a substrate containing a ceramic, and a resistor embedded in the substrate and containing another ceramic. The resistor includes two lead portions extending parallel to each other, a joint portion that connects one end of a lead portion to one end of another lead portion, and an electrode portion that is formed integrally with at least one lead portion of the two lead portions, has an end portion connected to the one lead portion, extends in a direction crossing an axial line of the one lead portion, and has another end portion exposed at an outer surface of the substrate. In a cross section of the electrode portion that is taken along an imaginary plane passing through the axial line of the one lead portion and parallel to an extending direction of the electrode portion, the following expression is satisfied, $0.1 \leq A/B \leq 0.8$, where A is a length of the other end portion parallel to the axial line, and B is the length of the one end portion parallel to the axial line. In the ceramic heater of this mode, the ratio A/B of the length A to the length B is from 0.1 to 0.8 inclusive. Therefore, the connection portion between the lead portion and the electrode portion can be smooth, and this can suppress the formation of a cavity in a portion of the substrate near the electrode portion during molding of that portion of the substrate. Therefore, a reduction in the strength of the ceramic heater due to the cavity can be suppressed. Since the ratio A/B is 0.1 or more, the slope of the connection portion of the electrode portion between the one end portion and the other end portion thereof is prevented from being excessively gentle. Therefore, variations in the surface area of the other end portion, which is exposed at the outer surface of the substrate as a result of polishing of a fired body in which the resistor is embedded in the substrate, can be suppressed. This can suppress variations in the electrical resistance of the ceramic heater. Since the ratio A/B is 0.8 or less, the connection portion of the electrode portion between the one end portion and the other end portion thereof can have a sufficiently gentle slope. Therefore, when the molding material of the substrate is supplied, the molding material can be completely distributed to the vicinity of the electrode portion, and the formation of a cavity in the vicinity of the electrode portion can be suppressed.

In the ceramic heater of the above-described mode, $1\ \text{mm} \leq A \leq 5\ \text{mm}$ may be satisfied. In the ceramic heater of this mode, the length A is 1 mm or more. Therefore, an increase in the electrical resistance of the ceramic heater, which occurs when the surface area of the other end portion is small, can be suppressed. Since the length A is 5 mm or less, a reduction in the overall strength of the ceramic heater, which occurs when the size of the electrode portion is large, can be suppressed.

In the ceramic heater of the above-described mode, in the cross section of the electrode portion, c is configured to be different from d, where c is a length that extends along the axial line formed between an edge of the one end portion located opposite the joint portion with respect to the axial direction and an edge of the other end portion located opposite the joint portion with respect to the axial direction, and d is a length that extends along the axial line formed between an edge of the one end portion located on a side toward the joint portion with respect to the axial direction and an edge of the other end portion located on the side toward the joint portion with respect to the axial direction. In the ceramic heater of this mode, the length c is different from the length d, so that the inclination of one of opposite sides of the connection portion of the electrode portion between the one end portion and the other end portion thereof can be made gentle. When the substrate is molded, the molding material of the substrate is supplied from the side opposite the side having the gentle inclination. This allows the molding material to be distributed to the side having the gentle inclination.

In the ceramic heater of the above-described mode, c<d may be satisfied. In the ceramic heater of this mode, by supplying the molding material from the side opposite the joint portion toward the joint portion, the molding material can be distributed to a region near the electrode portion, including a portion of the electrode portion connecting the edge of the one end portion on the side toward the joint portion with respect to the axial direction to the edge of the other end portion on the side toward the joint portion with respect to the axial direction.

The present invention can be embodied in various modes other than the ceramic heater. For example, the present invention can be embodied as a glow plug, a method of producing the ceramic heater, a method of producing the glow plug, a resistor for the ceramic heater, a method of producing the resistor, a substrate for the ceramic heater, and a method of producing the substrate.

BRIEF DESCRIPTION OF THE DRAWINGS

FIG. 8 is a table showing the results of evaluation of the strength and electrical resistance of each of heaters of Examples and Comparative Examples.

DETAILED DESCRIPTION OF THE INVENTION

A. Embodiments

A-1. Structure of Ceramic Heater

Figure 1:
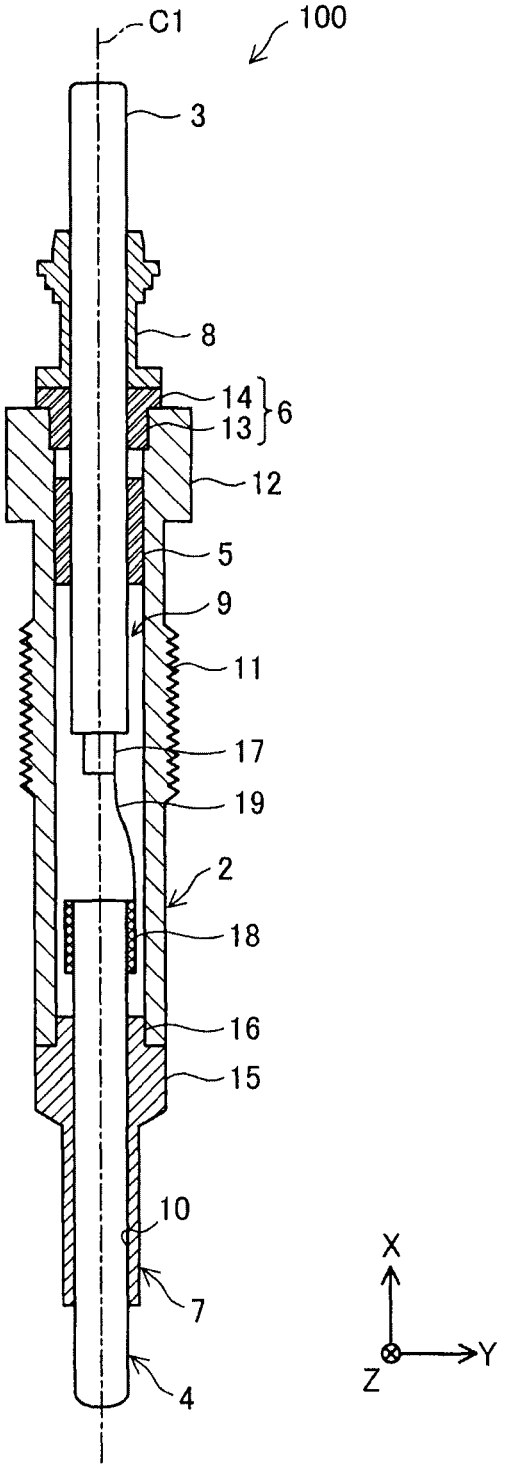
FIG. 1 is an explanatory view showing the structure of a glow plug to which a ceramic heater according to one embodiment of the present invention is applied.

FIG. 1 is an explanatory view showing the structure of a glow plug to which a ceramic heater according to one embodiment of the present invention is applied. The glow plug 100 has a rod-shaped outer shape and includes a metallic shell 2, a center shaft 3, an insulating member 5, an insulating member 6, a crimp member 8, an outer tube 7, a heater 4, an electrode ring 18, and a lead wire 19. In FIG. 1, an X axis is parallel to a center axis C1 of the glow plug 100, and Y and Z axes are perpendicular to the X axis. In the following description, the side of the glow plug 100 on which the heater 4 is disposed along the center axis C1 (a −X direction side) is referred to as a "forward end side," and the side on which the center shaft 3 is disposed along the center axis C1 (a +X direction side) is referred to as a "rear end side."

The metallic shell 2 is a metal-made member having an approximately cylindrical outer shape with an axial hole 9. On the outer circumferential surface of the metallic shell 2, a tool engagement portion 12 is formed at the rear end, and a male screw portion 11 is formed in a central portion. The tool engagement portion 12 has an outer shape (e.g., a hexagonal cross sectional shape) engageable with a prescribed tool and is engaged with the prescribed tool when the glow plug 100 is mounted to, for example, a cylinder head of an unillustrated engine. The male screw portion 11 is used to mount the glow plug 100 to the cylinder head of the unillustrated engine.

The center shaft 3 is a metal-made round bar-shaped member and is accommodated within the axial hole 9 of the metallic shell 2 such that a portion of the center shaft 3 on the rear end side protrudes from the rear end of the metallic shell 2. The center shaft 3 has at its forward end a small-diameter portion 17 smaller in diameter than the remaining portion. One end of the metal-made lead wire 19 is connected to the small-diameter portion 17, and the small-diameter portion 17 is electrically connected to the electrode ring 18 through the lead wire 19.

The insulating member 5 has a ring-like outer shape surrounding the center shaft 3 and is disposed within the axial hole 9 of the metallic shell 2. The insulating member 5 fixes the center shaft 3 such that the center axis of the metallic shell 2 and the center axis of the center shaft 3 coincide with the center axis C1 of the glow plug 100. The insulating member 5 electrically insulates the metallic shell 2 and the center shaft 3 from each other and serves as a hermetic seal therebetween. The insulating member 6 includes a tubular portion 13 and a flange portion 14. The tubular portion 13 has a ring-like outer shape, as does the insulating member 5, and is disposed at the rear end of the axial hole 9 so as to surround the center shaft 3. The flange portion 14 has a ring-like outer shape, and has a diameter larger than the outer diameter of the tubular portion 13. The flange portion 14 is disposed rearward of the tubular portion 13 so as to surround the center shaft 3, and electrically insulates the metallic shell 2 and the center shaft 3 from each other and the metallic shell 2 and the crimp member 8 from each other.

The crimp member 8 has an approximately cylindrical outer shape, is disposed so as to be in contact with the flange portion 14, and is then crimped so as to surround the center shaft 3 protruding from the rear end of the metallic shell 2. By crimping the crimp member 8 as described above, the insulating member 6 fitted between the center shaft 3 and the metallic shell 2 is fixed, so that the insulating member 6 is prevented from coming off the center shaft 3.

The outer tube 7 is a metal-made member having an approximately cylindrical outer shape with an axial hole 10 and is joined to the forward end of the metallic shell 2. A thick-walled portion 15 and an engagement portion 16 are formed at the rear end of the outer tube 7. The engagement portion 16 is disposed rearward of the thick-walled portion 15 and has an outer diameter smaller than the outer diameter of the thick-walled portion 15. The outer tube 7 is disposed such that the engagement portion 16 is fitted into the axial hole 9 of the metallic shell 2 and the thick-walled portion 15 is in contact with the forward end of the metallic shell 2. The outer tube 7 holds the heater 4 within the axial hole 10 such that the center axis of the heater 4 coincides with the center axis C1 of the glow plug 100.

The heater 4 has a cylindrical outer shape with a curved forward end surface and is fitted into the axial hole 10 of the outer tube 7. A portion of the heater 4 on the forward end side protrudes from the outer tube 7 and is exposed to an unillustrated combustion chamber. A portion of the heater 4 on the rear end side protrudes from the outer tube 7 and is accommodated within the axial hole 9 of the metallic shell 2. The structure of the heater 4 will be described in detail later. The heater 4 is formed of ceramic-based materials. The electrode ring 18 is a metal-made member and is fitted onto the rear end of the heater 4. One end of the lead wire 19 is connected to the electrode ring 18.

Figure 2:
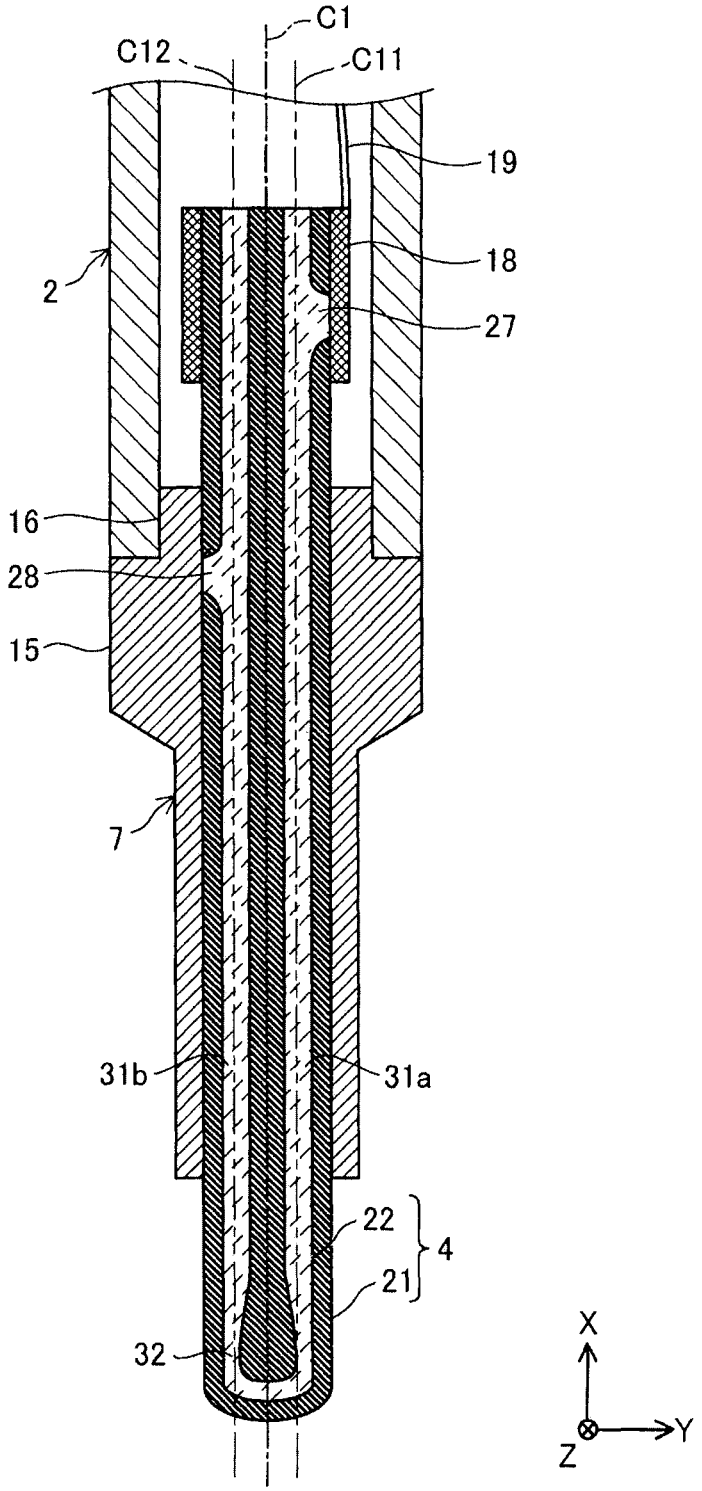
FIG. 2 is an enlarged partial cross-sectional view of the glow plug mainly showing the heater of FIG. 1.

FIG. 2 is an enlarged partial cross-sectional view of the glow plug, showing mainly the heater illustrated in FIG. 1. In FIG. 2, the same components as those in FIG. 1 are denoted by the same reference numerals, and their description will be omitted. As shown in FIG. 2, the heater 4 includes a substrate 21 and a resistor 22. The substrate 21 is formed of an insulating ceramic and has an approximately cylindrical outer shape with a curved forward end surface, and the resistor 22 is embedded in the substrate 21. The substrate 21 has two holes extending in a thickness direction (a direction parallel to the Y axis), and two electrode portions, described later, of the resistor 22 are accommodated in the two holes.

The resistor 22 includes a pair of lead portions 31*a* and 31*b* and a heat generation portion 32. Each of the pair of lead portions 31*a* and 31*b* is a rod-shaped member formed of a conductive ceramic and is disposed within the substrate 21. The pair of lead portions 31*a* and 31*b* are disposed such that their longitudinal directions are parallel to each other and their center axes (axial lines) C11 and C12 are parallel to the center axis C1 of the glow plug 100. The pair of lead portions 31*a* and 31*b* are disposed such that the three center axes C1, C11, and C12 are positioned in a single imaginary plane. An electrode portion 27 is disposed on the lead portion 31*a* to be located at a position close to the rear end thereof. The electrode portion 27 is formed integrally with the lead portion 31*a*. Specifically, the electrode portion 27 has one end connected to the lead portion 31*a* and extends in the radial direction of the lead portion 31*a*. The electrode portion 27 (a diameter reducing portion 272 described later) is accommodated in a corresponding hole of the substrate 21. An end portion of the electrode portion 27 that is opposite the end connected to the lead portion 31*a* is exposed at the surface of the substrate 21 and is in contact with the inner circumferential surface of the electrode ring 18. The electrode ring 18 is electrically connected to the lead portion 31*a* in the manner described above. An electrode portion 28 is disposed on the lead portion 31*b* at a position close to the rear end thereof and extends in the radial direction of the lead portion 31*b*. The electrode portion 28 is accommodated in a corresponding hole of the substrate 21, and an end portion of the electrode portion 28 that is opposite an end connected to the lead portion 31*b* is exposed at the surface of the substrate 21 and is in contact with the inner circumferential surface of the outer tube 7. The outer tube 7 is electrically connected to the lead portion 31*b* in the manner described above. Each of the pair of lead portions 31*a* and 31*b* is connected to the heat generation portion 32 to introduce electric current to the heat generation portion 32. Therefore, the center shaft 3 electrically connected to the electrode ring 18 through the lead wire 19 and the metallic shell 2 engaged with and electrically connected to the outer tube 7 serve as electrodes (positive and negative electrodes) used to supply electricity to the heat generation portion 32 in the glow plug 100.

Figure 3A:
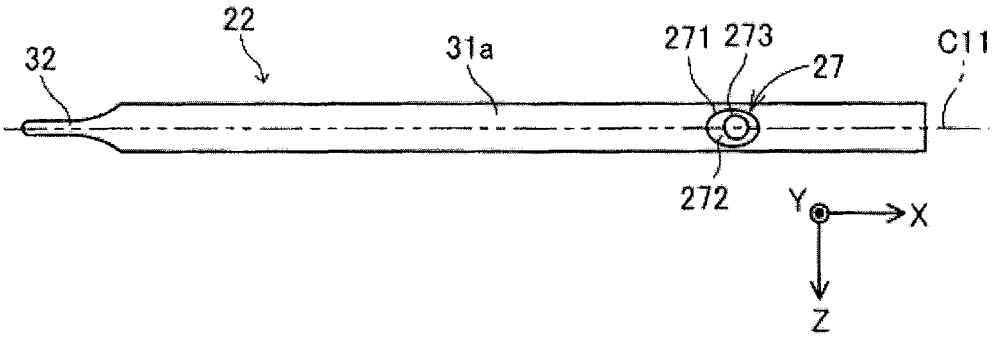
FIGS. 3(*a*) and 3(*b*) are explanatory views showing the outer shape of a resistor 22 in the present embodiment.
Figure 3B:
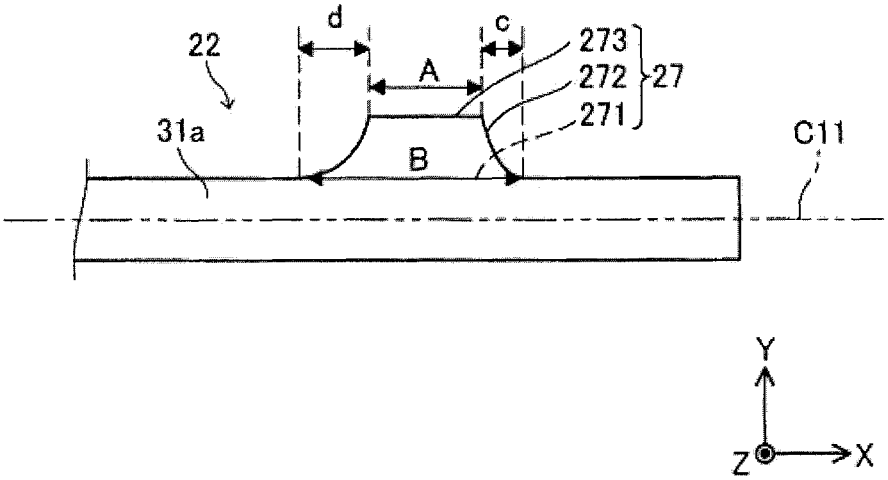

FIGS. 3(*a*) and 3(*b*) are explanatory views showing the outer shape of the resistor 22 in the present embodiment. FIG. 3(*a*) is a side view of the resistor 22 as viewed in a −Y direction. FIG. 3(*b*) is an enlarged partial cross-sectional view showing, on an enlarged scale, the electrode portion 27 and the vicinity thereof in a cross section of the lead portion 31*a* taken along an imaginary plane passing through the three center axes C1, C11, and C12. FIG. 3(*b*) shows the cross section of the lead portion 31*a* as viewed in a −Z direction.

As shown in FIGS. 3(*a*) and 3(*b*), the electrode portion 27 has an approximately truncated elliptical conical outer shape. The electrode portion 27 has a base portion 271, a diameter reducing portion 272, and an upper end portion 273. The base portion 271 corresponds to a portion connected to the lead portion 31*a* and has an approximately elliptical peripheral shape as shown in FIG. 3(*a*). In the electrode portion 27, the upper end portion 273 is located farthest from the lead portion 31*a* and comes into contact with the inner circumferential surface of the electrode ring 18. As shown in FIG. 3(*a*), the upper end portion 273 has an approximately circular peripheral shape. The peripheral shape of the upper end portion 273 may be approximately elliptic. The diameter of the upper end portion 273 is smaller than the lengths of the major and minor axes of the base portion 271. The diameter reducing portion 272 is a portion that continuously connects the base portion 271 to the upper end portion 273, and the cross-sectional shape of the diameter reducing portion 272 in a plane parallel to the X-Z plane is approximately elliptical. The cross-sectional shape of the diameter reducing portion 272 in a plane parallel to the X-Z plane may be approximately circular. The maximum diameter of the diameter reducing portion 272 in a cross section parallel to the X-Z plane decreases in a +Y direction. Therefore, the length A of the upper end portion 273 in a direction parallel to the center axis C11 is smaller than the length B of the base portion 271 in the direction parallel to the center axis C11. In the present embodiment, the ratio of the length A to the length B, i.e., A/B, satisfies formula (1) below.

$$0.1 \leq A/B \leq 0.8 \quad (1)$$

The ratio A/B is preferably from 0.1 to 0.7 inclusive, more preferably from 0.1 to 0.6 inclusive, and still more preferably from 0.1 to 0.5 inclusive. When the ratio A/B satisfies formula (1) above, the connection portion between the lead portion 31*a* and the electrode portion 27 is smooth, so that, when the material of the substrate 21 is injection-molded in a production process of the heater described later, the material can be completely distributed to the vicinity of a portion corresponding to the electrode portion 27. If the ratio A/B is less than 0.1, the inclination of the surface of the diameter reducing portion 272 becomes too small, and this may cause variations in the surface area of the upper end portion 273 formed in a polishing step described later. If the ratio A/B is larger than 0.8, the inclination of the surface of the diameter reducing portion 272 becomes too steep, so that, when the material of the substrate 21 is injection-molded in the production process of the heater, the material of the substrate 21 cannot be completely distributed to the portion corresponding to the electrode portion 27. In this case, a cavity may be formed in the vicinity of the portion corresponding to the electrode portion 27. In the present embodiment, the length A is from 1 mm to 5 mm inclusive. In the present embodiment, as viewed in the cross section, the outer circumferential edges of the diameter reducing portion 272 have an inwardly convex curved shape.

In the present embodiment, as shown in FIG. 3(*b*), length c and length d satisfy formula (2) below:

$$c < d. \quad (2)$$

Here, c is the length along the center axis C11 between an edge of the base portion 271 that is located opposite the heat generation portion 32 along the center axis C11 (the rear edge of the base portion 271) and an edge of the upper end portion 273 that is located opposite the heat generation portion 32 along the center axis C11 (the rear edge of the upper end portion 273). d is the length along the center axis C11 between an edge of the base portion 271 that is located on the side toward the heat generation portion 32 along the center axis C11 (the forward edge of the base portion 271) and an edge of the upper end portion 273 that is located on the side toward the heat generation portion 32 along the center axis C11 (the forward edge of the upper end portion 273).

When the length c and the length d satisfy formula (2) above, the material of the substrate 21 injection-molded in the production process of the heater described later can be completely distributed to the vicinity of the portion corresponding to the electrode portion 27. The detail of this effect will be described later. In the present embodiment, it is not essential that the length c and the length d satisfy formula (2) above. Therefore, the length c may be the same as the length d, or the length c may be larger than the length d.

The configuration of the lead portion 31*b* is the same as the above-described configuration of the lead portion 31*a*, and its detailed description will be omitted.

The heat generation portion 32 has a U-shaped outer shape and connects the forward (the −X direction side) ends of the two lead portions 31*a* and 31*b* to each other. The heat generation portion 32 generates heat when energized. To achieve high temperature by concentrating the electric current on the curved portion, the diameter of the curved portion is smaller than the diameter of the remaining portion of the heat generation portion 32 and the diameter of the lead portions 31*a* and 31*b*.

In the present embodiment, the conductive ceramic forming the lead portions 31*a* and 31*b* and the heat generation portion 32 is obtained, for example, by firing a conductive ceramic material containing, as a main component, silicon nitride serving as an insulating material and further containing tungsten carbide serving as an electrically conductive material. Specifically, the resistor 22 contains silicon nitride in an amount of from 56% by volume to 70% by volume inclusive and tungsten carbide in an amount of from 20% by volume to 35% by volume inclusive.

The heater 4 described above corresponds to a subgeneric concept of a ceramic heater. The heat generation portion 32 corresponds to a subgeneric concept of a joint portion, and the base portion 271 corresponds to a subgeneric concept of one end portion. The upper end portion 273 corresponds to a subgeneric concept of the other end portion.

A-2. Production of Glow Plug

Figure 4:
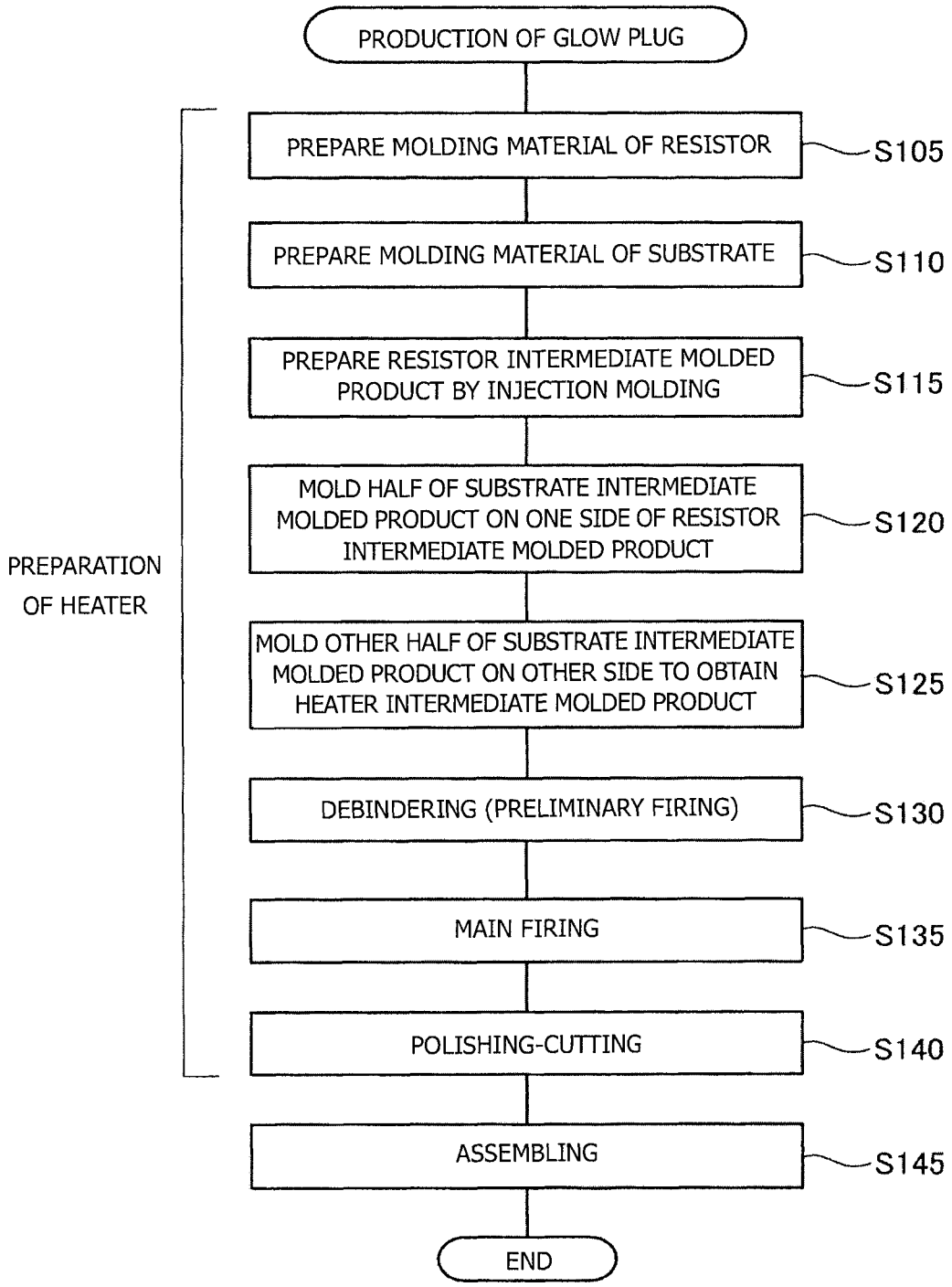
FIG. 4 is a flowchart showing a procedure for producing the glow plug 100.

FIG. 4 is a flowchart showing a procedure for producing the glow plug 100. First, a molding material of the resistor 22 is prepared (step S105), and then a molding material of the substrate 21 is prepared (step S110). In the present embodiment, the molding material of the resistor 22 is a powdery material containing an insulating ceramic and tungsten carbide as main components and can be prepared, for example, by mixing and pulverizing a raw insulating ceramic material and a raw ceramic material such as tungsten carbide, kneading the mixture, a binder, etc. using a kneader, and granulating the resultant mixture to form pellets. In the present embodiment, silicon nitride is used as the raw insulating ceramic material, but SIALON, for example, may be used instead of or in addition to the silicon nitride. In the present embodiment, no particular limitation is imposed on the binder. For example, one selected from binders such as polypropylene, plasticizers, waxes, dispersants, etc. or mixtures of two or more thereof may be used. In the present embodiment, the molding material of the substrate 21 is a powdery material containing an insulating ceramic as a main component and can be prepared, for example, by pulverizing a raw insulating ceramic material, kneading the pulverized product, a binder, etc. using a kneader, and granulating the resultant mixture to form pellets. The type of the raw ceramic material and the type of the binder may be the same as those for the molding material of the resistor 22.

An intermediate molded product of the resistor 22 is produced by injection molding using the molding material obtained in step S105 (step S115). In the present embodiment, "the intermediate molded product of the resistor 22" means a member that later becomes the resistor 22 through heating steps such as debindering and firing described later.

A half of an intermediate molded product of the substrate 21 is formed on one side of the intermediate molded product of the resistor 22 obtained in step S115 (step S120). The other half of the intermediate molded product of the substrate 21 is formed on the other side of the intermediate molded product of the resistor 22 to thereby obtain an intermediate molded product of the heater 4 (step S125). In each of steps S120 and S125, the molding material obtained in step S110 is injection-molded.

Figure 5:
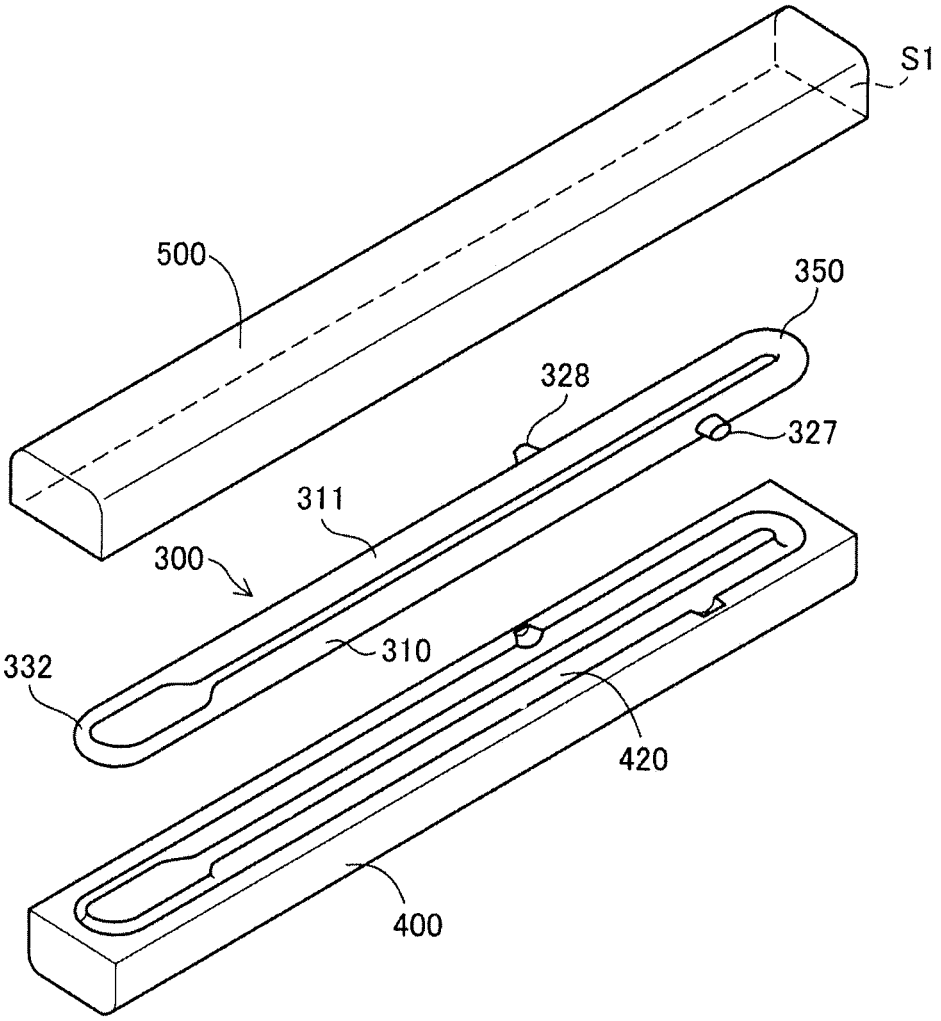
FIG. 5 is an explanatory view schematically showing the detail of the processing in step S120.
Figure 6:
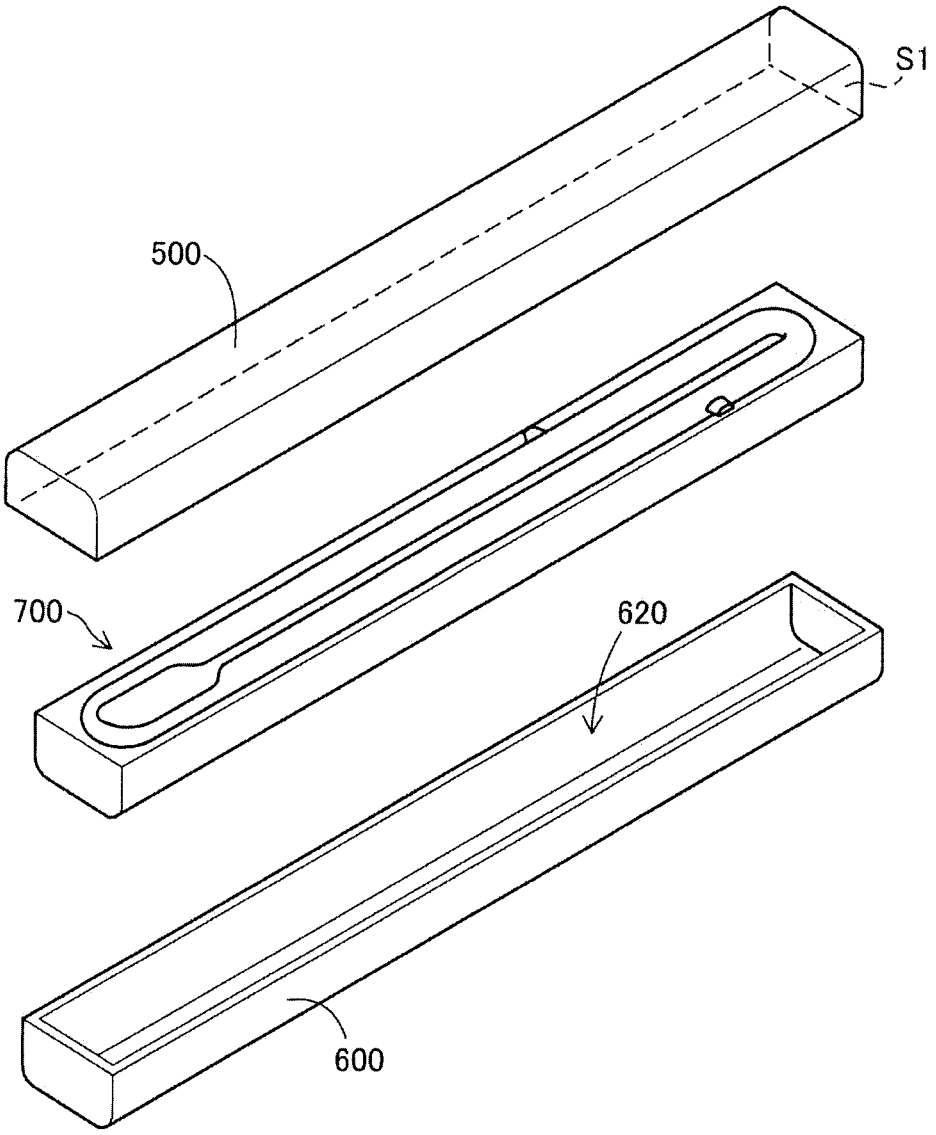
FIG. 6 is an explanatory view schematically showing the detail of the processing in step S125.

FIG. 5 is an explanatory view schematically showing the detail of the processing in step S120. FIG. 6 is an explanatory view schematically showing the detail of the processing in step S125. In step S120, first, the intermediate molded product 300 of the resistor 22 is placed in a cavity 420 formed in a lower die 400, and an upper die 500 is placed so as to cover the upper half of the intermediate molded product 300. The intermediate molded product 300 of the resistor 22 has an outer shape approximately geometrically similar to that of the resistor 22. Specifically, the intermediate molded product 300 includes a lead-forming portion 310 corresponding to the lead portion 31*a*, a lead-forming portion 311 corresponding to the lead portion 31*b*, a heat generation portion-forming portion 332 corresponding to the heat generation portion 32, and two electrode-forming portions 327 and 328 corresponding to the two electrode portions 27 and 28. The intermediate molded product 300 further includes a rear-end joint portion 350. In the intermediate molded product 300, the rear-end joint portion 350 connects ends of the two lead-forming portions 310 and 311 on the side opposite the heat generation portion-forming portion 332. The rear-end joint portion 350 is provided in order to prevent a change in the relative positions of the two lead-forming portions 310 and 311 to thereby facilitate the handling of the intermediate molded product 300.

The cavity 420 formed in the lower die 400 has a shape which allows the lower half of the intermediate molded product 300 of the resistor 22 to be fitted into the cavity 420. The upper die 500 has a hollow approximately rectangular cuboidal shape having an opening on its mating surface which mates with the lower die 400. An injection hole for filling the space inside the upper die 500 with a molding material is provided on one longitudinal end surface S1 of the upper die 500. After the intermediate molded product 300, the lower die 400, and the upper die 500 are disposed as described above, the molding material obtained in step S110 is injected into the upper die 500 to form a half of the intermediate molded product of the substrate 21 on one side (the upper side in FIG. 5) of the intermediate molded product of the resistor 22. An intermediate molded product 700 shown in FIG. 6 is thereby obtained.

In step S125, the intermediate molded product 700 obtained in step S120 is turned upside down to orient it as shown in FIG. 6 and is placed in a cavity 620 formed in a different lower die 600. Next, the upper die 500 is disposed so as to cover the upper half of the intermediate molded product 700. The cavity 620 formed in the lower die 600 has a shape which allows a portion of the intermediate molded product 700 corresponding to the intermediate molded product of the substrate to be closely fitted into the cavity 620. This upper die 500 is the same as the upper die 500 shown in FIG. 5. After the intermediate molded product 700, the lower die 600, and the upper die 500 are disposed as described above, the molding material obtained in step S110 is injected into the upper die 500 to form the other half of the intermediate molded product of the substrate 21 on the upper side of the intermediate molded product 700. The intermediate molded product of the heater 4 is obtained in the manner described above.

Figure 7:
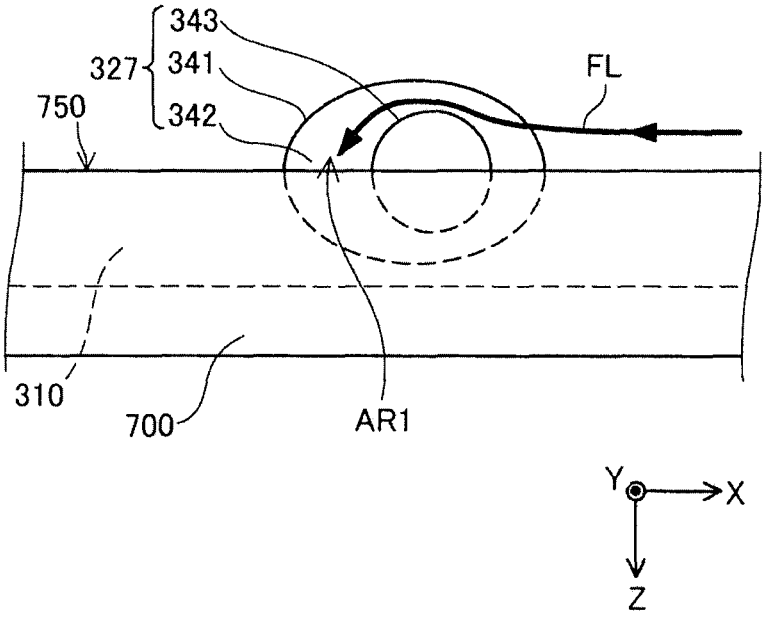
FIG. 7 is an explanatory view schematically showing the flow of a molding material in the vicinity of an electrode-forming portion 327.

FIG. 7 is an explanatory view schematically showing the flow of the molding material in the vicinity of the electrode-forming portion 327. In FIG. 7, the intermediate molded product 700 in step S125 is viewed in the −Y direction. In FIG. 7, the upper die 500 and the lower die 600 are omitted. In the present embodiment, a boundary surface 750 between the upper die 500 and the intermediate molded product 700 coincides with the imaginary plane passing through the three center axes C1, C11, and C12. The electrode-forming portion 327 includes a base portion-forming portion 341, a diameter reducing portion-forming portion 342, and an upper end-forming portion 343. The base portion-forming portion 341 corresponds to the base portion 271. The diameter reducing portion-forming portion 342 corresponds to the diameter reducing portion 272, and the upper end-forming portion 343 corresponds to the upper end portion 273.

As described above, in step S125, the molding material is injected into the upper die 500 from the end surface S1 of the upper die 500. Therefore, the molding material flows within the upper die 500 in a direction from the end surface S1 toward the surface on the opposite side. As shown by a thick solid arrow FL in FIG. 7, in the vicinity of the electrode-forming portion 327, the material flowing from the end surface S1 approximately in a −X direction reaches the diameter reducing portion-forming portion 342 of the electrode-forming portion 327. Since the cross-sectional shape of the diameter reducing portion-forming portion 342 in its cross section parallel to the X-Z plane is approximately elliptical, the molding material reaching the diameter reducing portion-forming portion 342 moves smoothly along the upper half surface of the diameter reducing portion-forming portion 342 in a direction toward the forward end of the diameter reducing portion-forming portion 342 (the −X direction). In the electrode-forming portion 327, its diameter decreases from the base portion-forming portion 341 toward the upper end-forming portion 343 (in the +Y direction). As viewed in the direction of the flow of the material (the −X direction), the upper half surface of the diameter reducing portion-forming portion 342 extends in the +Y direction such that its position gradually moves in the +Z direction. In other words, as viewed in the −X direction, the upper half surface of the electrode-forming portion 327 that extends in the +Y direction with a downward inclination. Therefore, when the molding material moves on the upper half surface of the diameter reducing portion-forming portion 342, part of the molding material moves in the +Y direction and flows into a region AR1 forward of and adjacent to the upper end-forming portion 343. The region AR1 is thereby filled with the molding material, and the formation of a cavity is suppressed.

As shown in FIG. 3(*b*), in the resistor 22, the length d is longer than the length c. This means that this relation also holds for the corresponding distances in the intermediate molded product 700 shown in FIG. 7. The distance corresponding to the length c is the distance along the center axis between an edge of the base portion-forming portion 341 that is located opposite the heat generation portion-forming portion 332 along the center axis (the rear edge of the base portion-forming portion 341) and an edge of the upper end-forming portion 343 that is located opposite the heat generation portion-forming portion 332 along the center axis (the rear edge of the upper end-forming portion 343) (this distance is hereinafter referred to as "length c11"). The distance corresponding to the length d is the distance along the center axis between an edge of the base portion-forming portion 341 that is located on the side toward the heat generation portion-forming portion 332 along the center axis (the forward edge of the base portion-forming portion 341) and an edge of the upper end-forming portion 343 that is located on side toward the heat generation portion-forming portion 332 along the center axis (the forward edge of the upper end-forming portion 343) (this distance is hereinafter referred to "length c12"). The length c11 and the length c12 satisfy formula (3) below.

$$c11<c12 \quad (3)$$

When formula (3) above holds, an inclined surface of the diameter reducing portion-forming portion 342 that is located forward of the upper end-forming portion 343 is relatively gentle, as in the diameter reducing portion 272 shown in FIG. 3(*b*). Since the material moves along such an inclined surface, the region AR1 is completely filled with the molding material, and the formation of a cavity in the region AR1 is suppressed.

After the intermediate molded product of the heater 4 is obtained in step S125 as shown in FIG. 4, debindering of the intermediate molded product of the heater 4 is performed (step S130). The intermediate molded product of the heater 4 contains the binder, and the binder is removed by heating (preliminary firing). For example, the intermediate molded product of the heater 4 may be heated at 800° C. in a nitrogen atmosphere for 60 minutes. After step S130, main firing is performed (step S135). In the main firing, heating is performed at higher temperature than the temperature of the preliminary firing in step S130. The heating may be performed at, for example, 1,750° C. In this case, so-called hot-press firing in which the intermediate molded product of the heater 4 is pressed may be performed.

Then polishing and cutting are performed (step S140). In this step, the outer circumference of the fired product obtained in step S135 is polished, and the forward end portion of the fired product is shaped into a curved surface. As a result of the polishing, the electrode portions 27 and 28 are exposed at the surface of the substrate 21. As a result of the cutting, the rear end portion of the fired product obtained in step S135, i.e., a portion corresponding to the rear-end joint portion 350, is removed. The heater 4 is completed through steps S105 to S140 described above. Then, components of the glow plug 100 shown in FIG. 1 are assembled (step S145), and the glow plug 100 is thereby completed.

In the glow plug 100 of the embodiment described above, the ratio of the length A to the length B, i.e., A/B, satisfies formula (1) above. Therefore, the connection portion between the lead portion 31*a* and the electrode portion 27 gently slopes, and also the connection portion between the lead portion 31*b* and the electrode portion 28 gently slopes. This allows the material used to form the intermediate molded product of the substrate 21 by injection molding to be completely distributed to the vicinity of the electrode-forming portions 327 and 328.

Since the ratio A/B is 0.1 or more, the inclination of the diameter reducing portion 272 is prevented from being excessively small. This can suppress variations in the surface area of the upper end portion 273 formed in the polishing step (step S140). The upper end portion 273 is a portion that comes into contact with the electrode ring 18. In the case of the electrode portion 28, a portion corresponding to the upper end portion 273 comes into contact with the outer tube 7. Therefore, if there are variations in the surface areas of these portions, variations in electrical resistance occur, and this causes variations in the heat generation performance of the heater 4. However, in the glow plug 100 of the embodiment, variations in the heat generation performance of the heater 4 can be suppressed.

Since the ratio A/B is 0.8 or less, the inclination of the diameter reducing portion 272 is sufficiently small. Therefore, when the molding material of the substrate 21 is supplied, the molding material can be completely distributed to the vicinities of the electrode-forming portions 327 and 328, and the formation of cavities in the vicinities of the electrode-forming portions 327 and 328, i.e., in the vicinities of the electrode portions 27 and 28, can be suppressed. Since the length c and the length d satisfy formula (2) above, the length c11 and the length c12 in the intermediate molded product 700 satisfy formula (3) above. Therefore, the inclination of an inclined portion of the diameter reducing portion-forming portion 342 that is located forward of the upper end-forming portion 343 can be relatively small, and the molding material can flow along this inclined portion, so that the region AR1 can be completely filled with the molding material. This can suppress the formation of a cavity in the region AR1. In steps S120 and S125, when the molding material reaches the vicinities of the electrode-forming portions 327 and 328, the molding material moves smoothly along the surfaces of the electrode-forming portions 327 and 328, and therefore the electrode-forming portions 327 and 328 are prevented from being deformed and damaged due to collisions of the molding material with the electrode-forming portions 327 and 328.

B. Examples

A plurality of the heaters 4 of the embodiment described above were produced, and their strengths and electrical resistances were measured and evaluated. FIG. 8 is a table showing the results of evaluation of the strengths and electrical resistances of heaters of Examples and Comparative Examples. FIG. 8 shows the value (mm) of the length A, the value (mm) of the length B, the strength (MPa), the resistance (mΩ), the length c (mm), and the length d (mm) of each of the heaters of the Examples and Comparative Examples.

The heaters of Examples 1 to 9 have different combinations of length A and length B and different combinations of length c and length d. The heaters of Examples 10 and 11 have the same combination of length A and length B but different combinations of length c and length d. In the heaters of Examples 1 to 9, the ratio A/B of the length A to the length B satisfies the relation of formula (1) above. However, in the heaters of Comparative Examples 1 to 3, the ratio A/B does not satisfy formula (1) above. Comparative Examples 1 to 3 have different combinations of length c and length d. 10 samples were produced for each of the heaters of the Examples and the Comparative Examples, The three-point bending strength of each of the heaters of the Examples and the Comparative Examples was measured with a span of 12 mm. In this measurement, the surface on which the upper end portion of the electrode portion 28 was disposed was used as a tensile surface. FIG. 8 shows the average values for the heaters of the Examples and the Comparative Examples. In the results of the evaluation of strength in FIG. 8, "A" (a good rating) is given when the strength is 1,050 MPa or more, "B" (a fair rating) is given when the strength is 1,000 MPa or more and less than 1,050 MPa, and "C" (a poor rating) is given when the strength is less than 1,000 MPa.

The results of the evaluation of the strength for Examples 1 to 13 were good, i.e., fair or higher. The reason that the rating of the strength of the heaters of Example 8 is "B" may be that the length A is relatively large, 8 mm, and the electrode portion 28 itself is large, so that the overall strength of the heater is low. In each of the heaters of Comparative Examples 1 and 2, the strength was "C" (a poor rating). In Comparative Example 1, a reduction in strength was observed. This may be because of the following reason. The length A is two times the length B, and the electrode portion 28 is increased in diameter from the base portion toward the upper end portion. Therefore, in steps S120 and S125, the molding material does not flow into the upper end portion side, and a cavity is formed, causing a reduction in strength. In Comparative Example 2, a reduction in strength was observed. This may be because of the following reason. The length A is the same as the length B. Therefore, in steps S120 and S125, the molding material does not flow into the upper end portion side, and a cavity is formed, causing a reduction in strength, as in Comparative Example 1.

In the heaters of Examples 5 and 10 to 13, the values of the length A are the same, and the values of the length B are the same. Among them, the heaters of Examples 5, 12, and 13 satisfy formula (2) above for the length c and the length d (c<d). However, the heaters of Examples 10 and 11 do not satisfy formula (2) above. As for the strengths of the heaters of Examples 5 and 10 to 13, the strengths of the heaters of Examples 5, 12, and 13 are 1,200 MPa or more, but the strengths of the heaters of Examples 10 and 11 are 1,080 MPa or less. This may be because of the following reason. In the heaters of Examples 5, 12, and 13 in which the length c and the length d satisfy formula (2) above, the region AR1 can be completely filled with the molding material in steps S120 and S125. Therefore, the formation of a cavity in the region AR1 can be suppressed, and high strength is achieved. However, in the heaters of Examples 10 and 11 in which the length c and the length d do not satisfy formula (2) above, a small cavity is formed in the region AR1, causing a reduction in strength.

As can be seen from the results of the strength evaluation, the ratio A/B is preferably from 0.1 to 0.8 inclusive. As also can be seen, the length A is preferably from 0.05 mm to 5 mm inclusive. As also can be seen, it is preferable that the length c and the length d satisfy the relation represented by formula (2) above, i.e., c<d.

The electrical resistance of each of the heaters of the Examples and the Comparative Examples was measured. The electrical resistance can be measured by any known method. In FIG. 8, the average value (unit: mΩ) for each of the heaters of the Examples is shown. In the results of the evaluation of the electrical resistance in FIG. 8, "A" (a good rating) is given when the electrical resistance is less than 700 mΩ, and "B" (a fair rating) is given when the electrical resistance is 700 mΩ or more. The evaluation result for Comparative Example 3 is "C," and this will be described later.

The results of the evaluation of the electrical resistance for Examples 1 to 13 were good, i.e., fair or higher. The reason that the rating of the electrical resistances of the heaters of Example 9 is "B" may be that the length A is very small (0.05 mm) and the surface area of the upper end portion is much smaller than those of the heaters of other Examples. The rating for the heaters of Comparative Example 3 is "C," and this means that the variation in resistance among the ten samples of the heater of Comparative Example 3 is very large. In Comparative Example 3, the ratio A/B is very small, i.e., 0.05. This means that the inclination of the diameter reducing portion 272 is very small. In this case, the surface area of the upper end portion 273 can vary greatly depending on the degree of polishing in step S140. This may be the reason that there is a large variation in electrical resistance among the samples of the heater.

As can be seen from the results of the electrical resistance evaluation, the ratio A/B is preferably from 0.1 to 0.8 inclusive. As also can be seen, the length A is preferably from 1 mm to 5 mm inclusive.

C. Modifications

C1. Modification 1

In the above embodiments and Examples, both the electrode portion 27 and the electrode portion 28 satisfy formula (1) above. However, only one of the two electrode portions 27 and 28 may satisfy formula (1) above.

C2. Modification 2

In the above embodiments, the length c and the length d satisfy formula (2) above (c<d), but the present invention is not limited thereto. The length c may be the same as the length d, or the length c may be greater than the length d. Even in a configuration in which the length c is greater than the length d, the same effects as those of the embodiments and Examples can be obtained when the direction of injection of the molding material in steps S120 and S125 is opposite to that in the embodiments and Examples. In this configuration, an injection hole for the molding material may be provided in an end surface of the upper die 500 that is close to the heat generation portion-forming portion 332. Specifically, a configuration in which the length c is not the same as the length d may generally be used.

C3. Modification 3

Figure 9A:
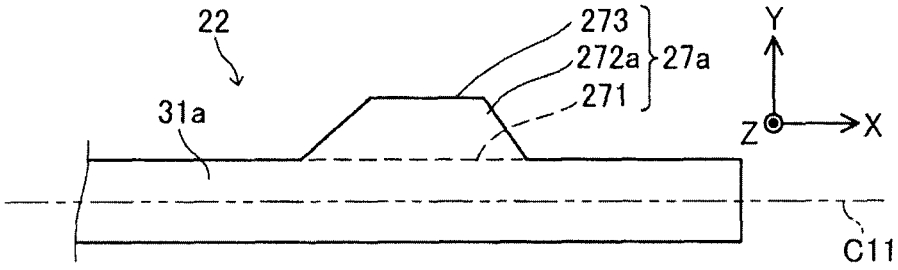
FIGS. 9(*a*), 9(*b*) and 9(*c*) are explanatory views showing the outer shapes of electrode portions according to a modification.
Figure 9B:
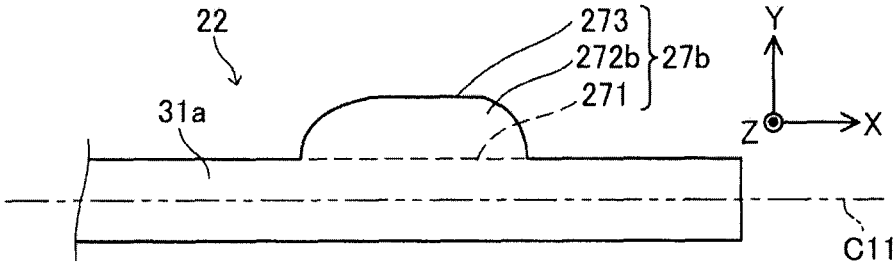
Figure 9C:
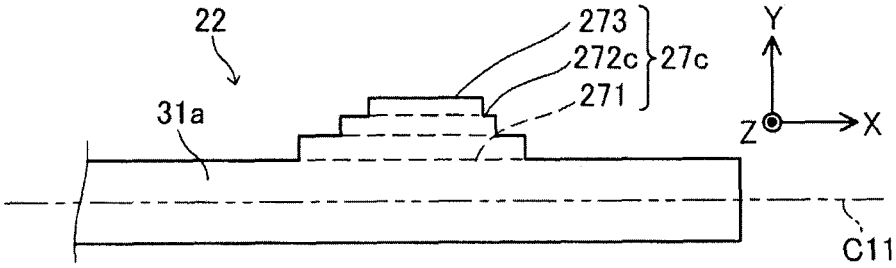

In the above embodiments and Examples, the outer shape of the diameter reducing portion 272 is such that the maximum diameter in a cross section parallel to the X-Z plane decreases in the +Y direction and that the outer circumferential edges in a cross section parallel to the X-Y plane have an inwardly convex curved shape, but the present invention is not limited thereto. FIGS. 9(*a*) to 9(*c*) are explanatory views showing the outer shapes of electrode portions in modification 3. In each of FIGS. 9(*a*) to 9(*c*), as in FIG. 3(*b*), a cross section of the lead portion 31*a* in the vicinity of the electrode portion as viewed in the −Z direction is shown. FIG. 9(*a*) shows a first mode of the diameter reducing portion in modification 3. FIG. 9(*b*) shows a second mode of the diameter reducing portion in modification 3. FIG. 9(*c*) shows a third mode of the diameter reducing portion in modification 3.

An electrode portion 27*a* in the first mode of modification 3 shown in FIG. 9(*a*) is different from the electrode portion 27 in the embodiment shown in FIG. 3(*b*) in that the electrode portion 27*a* has a diameter reducing portion 272*a* instead of the diameter reducing portion 272. The shape of the outer circumferential edges of the cross section of the diameter reducing portion 272*a* is straight.

An electrode portion 27*b* in the second mode of modification 3 shown in FIG. 9(*b*) is different from the electrode portion 27 in the embodiment shown in FIG. 3(*b*) in that the electrode portion 27*b* has a diameter reducing portion 272*b* instead of the diameter reducing portion 272. The outer circumferential edges of the cross section of the diameter reducing portion 272*b* have an outwardly convex curved shape.

An electrode portion 27*c* in the third mode of modification 3 shown in FIG. 9(*c*) is different from the electrode portion 27 in the embodiment shown in FIG. 3(*b*) in that the electrode portion 27*c* has a diameter reducing portion 272*c* instead of the diameter reducing portion 272. The outer circumferential edges of the cross section of the diameter reducing portion 272*c* have a staircase shape.

Even in the heaters having the electrode portions 27*a* to 27*c* shown in FIGS. 9(*a*) to 9(*c*), the same effects as those of the heaters 4 of the above embodiments and Examples can be obtained so long as the ratio A/B of the length A to the length B satisfies (1) described above.

C4. Modification 4

In the above embodiments, the intermediate molded product of the heater 4 is formed by injection molding in steps S120 and S125. However, the intermediate molded product may be formed using any molding method such as powder press forming, sheet laminating molding, or casting, instead of injection molding.

C5. Modification 5

In the above embodiments, the intermediate molded product 700 obtained in step S120 is turned upside down and is then fitted into the cavity 620 of the lower die 600 in step S125, but the present invention is not limited thereto. For example, after completion of step S120, the lower die 400 may be replaced with a new lower die with the upper die 500 disposed on the upper portion of the intermediate molded product 700. Then the molding material may be injected into the lower die to thereby obtain the intermediate molded product of the heater 4. In this configuration, the new lower die used may be, for example, a die having the same shape as the shape of the upper die 500.

C6. Modification 6

In the above embodiments and Examples, the electrically conductive material in the molding material of the resistor 22 is tungsten carbide. However, any electrically conductive material such as molybdenum silicide or tungsten silicide may be used instead of tungsten carbide.

C7. Modification 7

In the above embodiments, the heater 4 is a ceramic heater used for the glow plug 100. The heater 4 may be used for components other than the glow plug 100. Specifically, the heater 4 may be an ignition heater for a burner, a heater for heating a gas sensor, or a ceramic heater used for a DPF (diesel particulate filter).

The present invention is not limited to the above described embodiments and modifications and may be embodied in various other forms without departing from the spirit of the invention. For example, the technical features in the embodiments and modifications corresponding to the technical features in the modes described in Summary of the Invention can be appropriately replaced or combined to solve some of or all the foregoing problems or to achieve some of or all the foregoing effects. A technical feature which is not described as an essential feature in the present specification may be appropriately deleted.

DESCRIPTION OF REFERENCE NUMERALS

2: metallic shell
3: center shaft
4: heater
5: insulating member
6: insulating member
7: outer tube
8: crimp member
9: axial hole
10: axial hole
11: male screw portion
12: tool engagement portion
13: tubular portion
14: flange portion
15: thick-walled portion
16: engagement portion
17: small-diameter portion
18: electrode ring
19: lead wire
21: substrate
22: resistor
27: electrode portion
27*a*: electrode portion
27*b*: electrode portion
27*c*: electrode portion
28: electrode portion
31*a*: lead portion
31*b*: lead portion
32: heat generation portion
100: glow plug
271: base portion
272: diameter reducing portion
272*a*: diameter reducing portion
272*b*: diameter reducing portion
272*c*: diameter reducing portion
273: upper end portion
300: intermediate molded product
310: lead-forming portion
311: lead-forming portion
327: electrode-forming portion
328: electrode-forming portion
332: heat generation portion-forming portion
341: base portion-forming portion
342: diameter reducing portion-forming portion
343: upper end-forming portion
350: rear-end joint portion
400: lower die
420: cavity
500: upper die
600: lower die
620: cavity
700: intermediate molded product
750: boundary surface
AR1: region
C1: center axis
C11: center axis
C12: center axis
S1: end surface

The invention claimed is:

1. A ceramic heater comprising:

a substrate containing a ceramic; and a resistor embedded in the substrate and containing another ceramic, the resistor including;

two lead portions extending parallel to each other, a joint portion that connects one end of a lead portion to one end of another lead portion, and an electrode portion that is formed integrally with at least one lead portion of the two lead portions, has an end portion connected to the one lead portion, extends in a direction crossing an axial line of the one lead portion, and has another end portion exposed at an outer surface of the substrate;

wherein, in a cross section of the electrode portion that is taken along an imaginary plane passing through the axial line of the one lead portion and parallel to an extending direction of the electrode portion, the following expression is satisfied, $$0.1 \leq A/B \leq 0.8,$$

where A is a length of the other end portion parallel to the axial line, and B is the length of the one end portion parallel to the axial line, and wherein, in the cross section of the electrode portion, c is configured to be different from d, where c is a length that extends along the axial line formed between an edge of the one end portion located opposite the joint portion with respect to the axial direction and an edge of the other end portion located opposite the joint portion with respect to the axial direction, and d is a length that extends along the axial line formed between an edge of the one end portion located on a side toward the joint portion with respect to the axial direction and an edge of the other end portion located on the side toward the joint portion with respect to the axial direction.

2. The ceramic heater according to claim 1, wherein 1 mm≤A≤5 mm is satisfied.

3. The ceramic heater according to claim 1, wherein c<d is satisfied.

4. A glow plug comprising the ceramic heater according to claim 1.

5. A glow plug comprising the ceramic heater according to claim 2.

6. A glow plug comprising the ceramic heater according to claim 3.

* * * * *